US005444432A

United States Patent [19]

Pildner et al.

[11] Patent Number: 5,444,432

[45] Date of Patent: Aug. 22, 1995

[54] DETECTION SIGNAL EVALUATION AT VARYING SIGNAL LEVELS

[75] Inventors: Reinhart K. Pildner, Brampton; Dennis Cecic, Scarborough, both of Canada

[73] Assignee: Digital Security Controls Ltd., Downsview, Canada

[21] Appl. No.: 915,178

[22] Filed: Jul. 20, 1992

[51] Int. Cl.[6] ..... G08B 13/18

[52] U.S. Cl. ..... 340/567; 340/522

[58] Field of Search ..... 340/567, 522, 577–578, 340/661, 587, 511–512, 825.57

[56] References Cited

U.S. PATENT DOCUMENTS

| | | | |
|---|---|---|---|
| 4,206,451 | 6/1980 | Kurshner | 340/522 |
| 4,746,910 | 5/1988 | Pfister et al. | 340/567 |
| 5,077,548 | 12/1991 | Dipoala | 340/522 |
| 5,194,848 | 3/1993 | Kerr | 340/522 X |

FOREIGN PATENT DOCUMENTS

| | | | |
|---|---|---|---|
| 20690 | 1/1991 | Japan | 340/567 |

*Primary Examiner*—John K. Peng
*Assistant Examiner*—Thomas J. Mullen, Jr.

[57] ABSTRACT

An arrangement and method for processing signals from infrared intrusion detectors is disclosed which allows the signal to be processed at different amplitude levels to recognize different signal characteristics. This capability to analyse the signal at different values allows further customizing of the system for particular applications and provides information useful in recognizing and dealing with unwanted signal changes. The system also accommodates increasing the effect on certain portions of the signal when considering the net overall effect of the signal. This results in more signal information being available and higher accuracy in detecting actual human intrusions in the monitored space.

18 Claims, 4 Drawing Sheets

DETECTION SIGNAL EVALUATION AT VARYING SIGNAL LEVELS

BACKGROUND OF THE INVENTION

The present invention relates to intrusion detectors and in particular relates to a new arrangement and method for processing the signals received from passive infrared detectors.

Passive infrared intrusion detectors are often used in combination with a microwave detection arrangement to provide a detector having a dual technology which is less prone to false alarms and is generally considered more reliable. Various types of detectors are often combined to provide improved reliability and increased sophistication. The present invention will be discussed with respect to single infrared intrusion detectors, however, it would be appreciated by anyone skilled in the art that this arrangement can be used in any system using a passive infrared detector or other detector or system having a similar type signal.

The signal from a passive infrared detector with respect to the disturbances which occur in the area being monitored is an alternating signal sometimes considered predominantly sinusoidal whose magnitude typically varies between 0 and 3.6 volts peak to peak (5 volts supply) and whose frequency varies from 0.1 to 10 hertz.

Some approaches for analyzing this signal include the use of two comparators, one for evaluating positive portion of the signal and the other for evaluating the negative portion. Pulses are produced when the signal exceeds the threshold of the respective comparator and are of a duration corresponding to the time that the signal remains above the minimum threshold. Thus positive pulses of variable duration have been derived by use of two comparators for evaluating positive and negative portions of the signal from the infrared detector. It is also possible to rectify the signal and merely use a single comparator for evaluation of the signal. The problems with the comparator approach is that it is difficult to determine what the best minimum threshold is. A number of factors can affect the signal from the detector and not all of these disturbances indicate that a burglar or intruder is present. RF transient signals produced in walkie-talkies, etc. can produce a very strong short duration signal. Heaters coming on within the monitored area can produce a detectable signal as well as small animals such as a cat, etc., crossing through the zone. Therefore, a problem arises in trying to distinguish between the presence of a human intruder and a disturbance in the signal which is not produced by such an intruder.

A different approach has been to integrate the output signal as this integration is in effect the measurement of the energy of the signal and it is believed this measurement is more indicative of whether an intruder is present. Unfortunately other factors enter into the consideration such as the ability of the system to detect the desired intruder at a long distance from the detector which typically produces a fairly low frequency signal. Other problems also occur due to the widely varying ambient temperature conditions that can occur in the monitored area.

Many systems have used a single comparator to produce a pulse which is counted, and if sufficient pulses are produced within a certain time period an alarm condition is produced. Counting arrangements can produce false alarms as common environmental disturbances such as blasts of hot air from the heating vents will produce the same unit of information as the sensing of a valid target. In order to reduce the occurrence of false alarms it is possible to increase the comparator trip threshold and/or increase the number of pulses counted before an alarm is generated. Both of these techniques will indeed improve the false alarm immunity however this will be accomplished at the expense of the detection range of the unit. If the number of pulses counted before an alarm condition is produced is increased far detection range will be decreased since far targets will produce few pulses (due to low amplitude and frequency). If the thresholds are increased, far response will again be reduced since the far signals are of lower amplitude. It is for these reasons that maximum pulse setting allowed is typically 3.

In one prior art arrangement the output signal from the detector is fed into an absolute value circuit and subsequently to a voltage controlled pulse generator subsection. When the signal reaches a minimum amplitude the voltage controlled pulse generator begins to produce constant width pulse at a repetition rate proportional to the amplitude of the signal typically in the hundreds of hertz. These pulses are counted or integrated and stored by the means of a capacitor. When the stored energy reaches a preset level an alarm signal is generated. This system suffers the same basic draw backs as a window comparator system in that slowly changing low amplitude transients which barely cross over the threshold generate full amplitude pulses which are integrated towards a possible alarm generation.

Since the slow transients are allowed to produce the same unit of information as valid distance targets the low frequency response of the amplifier has been set to de-emphasize low frequency response to reduce the probability of false alarms. Unfortunately since distant valid targets produce low frequency signals the overall pattern coverage is decreased as a result.

According to a different arrangement the sinusoidal signal is fed into an absolute value circuit and when this signal exceeds a minimum threshold its amplitude is used to vary the charge current of a capacitor which is used as a energy storage device. The charging current equation is $$I_{charge}=(V_{signal}-V_{minimum\ threshold})/R_{charge}$$

When a certain amount of energy over time (in volt seconds) has been accumulated in the capacitor the unit will signal an alarm. This technique is an improvement over previous methods in that the effects of low amplitude transients which barely cross over the minimum threshold are reduced. This is accomplished as their energy over time is low and thus their contribution to the accumulated total energy is low. This technique does require the gain of the amplifier to be excessively high to quickly generate an alarm condition by far-off targets moving at low speed. This presents a problem for RF induced transients which are greatly amplified as a result of this excessive gain requirement.

The present invention seeks to overcome the problems associated with the prior art techniques and provide a system having improved information processing allowing more accurate evaluation of the signal. The invention in the simplest form is relatively inexpensive but the system is also capable of a high degree of sophistication and evaluation of the signal for more demanding applications.

SUMMARY OF THE INVENTION

The present invention relates to a method of processing an output signal from a passive infrared detector of an intrusion detection system where the output signal corresponds to the changes in the area being monitored. The method comprises processing the output signal to produce at least first and second sets of pulses. Each pulse of the first set of pulses is produced when a signal is of an amplitude exceeding a first predetermined level and being of a duration corresponding to the duration the signal is maintained above the first predetermined level. Each pulse of the second set of pulses is produced during a pulse of said first set of pulses when the signal exceeds a second predetermined level which is higher than the first predetermined level. The duration of the pulses of the second set of pulses correspond to the duration the signal is maintained above the second predetermined level. This system requires analyzing the set of pulses to evaluate whether an alarm condition exists. With this arrangement the output signal has been broken up into segments for a stepped evaluation to allow evaluation of the signal at different levels and in a preferred form allows evaluation of the rate of change of the signal between respective levels. This arrangement allows more accurate evaluation of the signal in a very simple and low cost apparatus.

The present invention is also directed to an arrangement for processing an output signal for a passive infrared detector of an intrusion detection system. The output signal corresponds to the changes in the area being monitored and comprises a series of progressive comparators having different stepped minimum thresholds within the normal amplitude range of the signal of interest. The arrangement includes means for producing a signal predetermined amplitude from each comparator and of a duration corresponding to the duration the signal is above the respective minimum threshold. The system also includes means for applying different weighting factors to the signal from each comparator and means for combining the weighted signals and evaluating the combined signal by means of a function of the integration of the combined weighted signals. This arrangement allows for customization of the system characteristics for a particular application.

BRIEF DESCRIPTION OF THE DRAWINGS

Preferred embodiments of the invention are shown in the drawings wherein.

DETAILED DESCRIPTION OF THE PREFERRED EMBODIMENTS

The present invention allows increased flexibility for allowing valid motion to be distinguished from naturally occurring disturbances which previously have produced signals which were incorrectly identified as valid motion. The technique may be implemented using conventional means such as analog circuit design techniques. The technique is also readily implemented using digital techniques to take advantage of the long term product stability, manufacturability and design flexibility offered by Digital Design.

Figure 3:
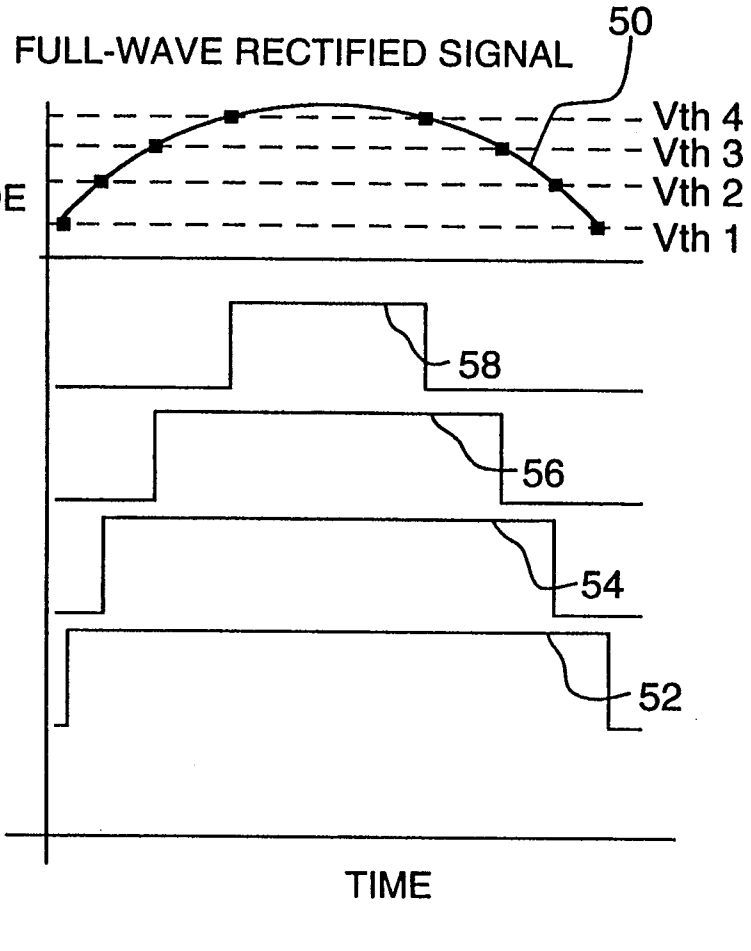
FIG. 3 is a schematic of the response from a generally symmetrical pulse of a full wave rectified signal when processed by the four comparator system with the resulting pulses being shown.

A typical signal from the output of a infrared motion detection device is shown in FIG. 3 and it can be seen that this is somewhat sinusoidal in nature.

Figure 1A:
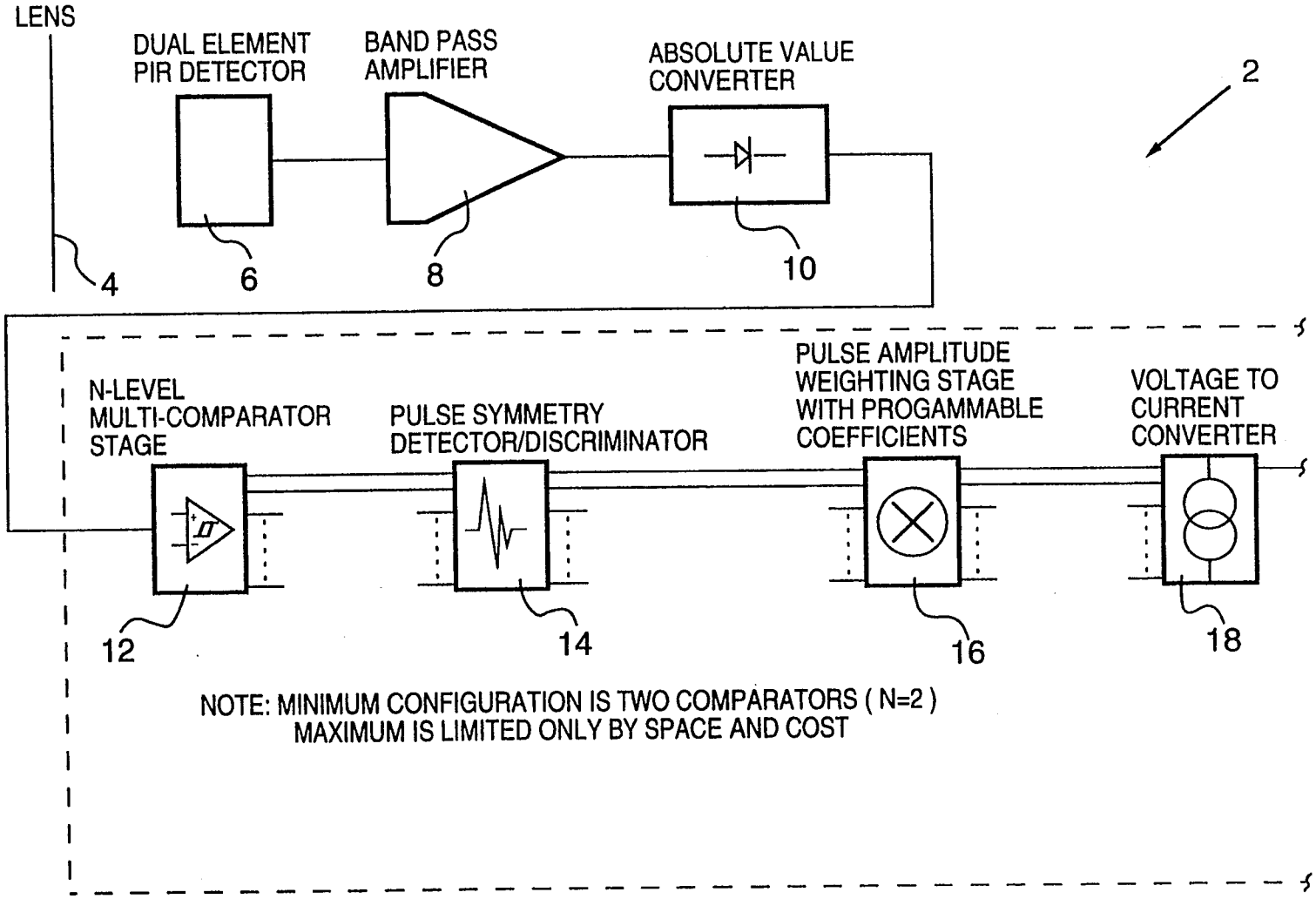
FIGS. 1A and 1B are a schematic layouts of the passive infrared detector.
Figure 1B:
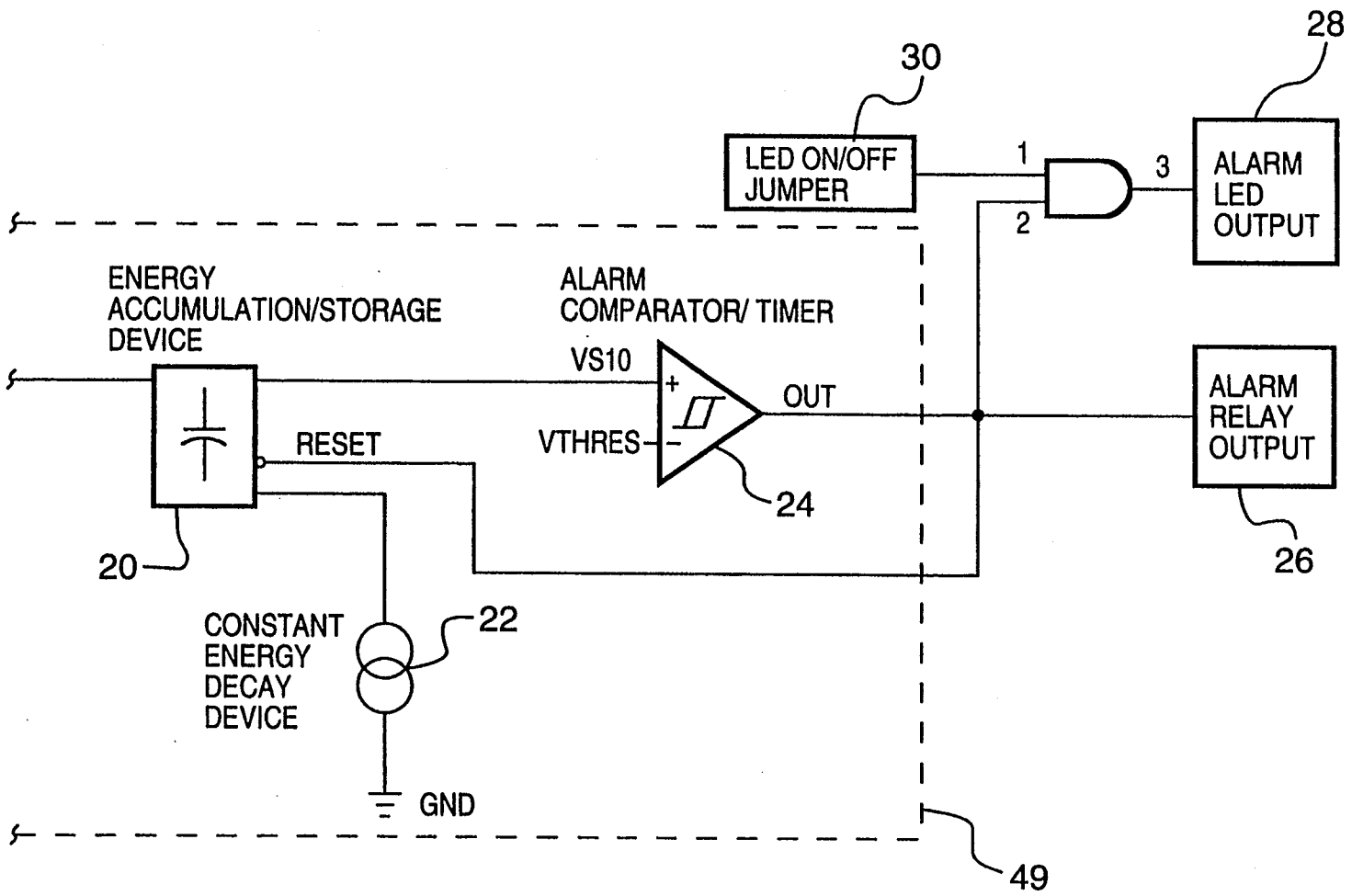

A schematic of the infrared motion detector system is shown in FIG. 1. The system includes a lens assembly 4 which focuses infrared energy originating from sources within the area of coverage on the two dual element passive infrared detector shown as 6. The resulting output is amplified and band pass filtered by the band pass amplifier shown as 8. The band width of the band pass amplifier 8 is approximately 0.1 hertz to 10 hertz.

The signal is then passed through an absolute value convertor 10 which is a full wave rectifier. This technique is used to conveniently analyze average energy content in the cyclic signals.

The full wave rectified signal is then fed into an n level multi comparator stage 12 which has been preconfigured to analyze the maximum dynamic range of the signal by evaluating the signal at n predetermined minimum threshold values stepped throughout the maximum dynamic range. As the input signal crosses each of these thresholds, a corresponding output pulse is generated at the corresponding comparator output. The pulse has a fixed magnitude, which is a function of the dynamic range of the system. The area under the rectified signal which represents the energy over time of a target may be approximated by accumulation of the areas of the output pulses from multi stage comparator 12. The more levels that are used, the more information that is extracted from the input signal. The output pulses from the n level multi comparator 12 are then passed through the pulse symmetry detector discriminator 14 which is sensitive to the instantaneous change in the number of comparator outputs tripped. If the rate is too high due an RF induced transient event for example, the result in output pulses to the next section, i.e., the pulse amplitude weighting stage 16 are reduced in duration reducing their effect on the energy accumulation storage mechanism 20. The pulse symmetry detector discriminator 14 is tailored to detect the symmetry of an RF induced transient signal which is shown in FIG. 3 and is characterized by a sharp initial transition followed by an exponential decay. For normal signals, the output pulses from the pulse symmetry detector discriminator 14 are identical to the pulses originating from the n level multi comparator 12.

It has been found that it is desirable to apply different weighting factors to the pulses from different stages. For example, although the information which is of relatively low amplitude may include some false information, the information is certainly valuable and cannot be ignored. However, when the signal is above this minimum level by a certain amount detected by the next comparator this information is a much clearer indication that a valid intruder motion detection has occurred. Therefore, different weighted factors may be applied to the different stream of pulses coming from the n level comparator. It can also be appreciated that custom tailoring of the response and weighting factors can make adjustments for particular ambient conditions or particular needs of the area being detected. Thus, it allows selection, variation and tailoring of the system to the particular environment in which it is being placed or the application that it is intending to protect. For example, it could allow customization to effect a system which is more sensitive to slow movement versus fast movement or more sensitive to near targets versus far targets. For example, far off detection may be enhanced without increasing the probability of false alarms due to heaters by increasing the weighted factors used on the second and third level comparator outputs while decreasing the weighting factor of the first level comparator outputs which is typically the minimum level of interest. The weighting factors directly effect the rate of charging the energy accumulation storage device 20 per recognized event. The pulses which are most often produced by human motion near or far, moving slow or fast will be given the most weight while those most often produced by common transients will be given a lower weight. The more comparators implemented the higher the degree of sophistication possible and the increased ability to distinguish between various disturbance sources throughout the monitored range.

This in effect allows a low or overall weight to be assigned to "average" signal energy produced by transients and high overall weight to the average signal energy produced by valid motion to minimize the probability of false alarms while enhancing the detection capability of the detector. This capability is not possible via traditional single time constant single threshold systems. This weighting factor provides a further degree of freedom and allows the amplifying requirements to be less demanding.

The weighted pulses are then literally added by the voltage to current converter 18. The output signal represents a weighted modification of the input signal energy. The weighting factors can also be adjusted to more accurately reflect the energy under the curve or in contrast may be used to change that assessment of energy by increasing or decreasing certain portions thereof to provide more accurate sensory response. The point of this system is not to match the energy within the system but to validly detect targets within the area being monitored. This system allows tailoring of the response to achieve this result and tailoring of the system to affect the environment in which it is placed.

The counted weighted pulses from the voltage to current converter 18 are stored in the energy accumulation storage device 20. If a signal energy sufficient to accumulate energy quicker than it is discharged by the constant energy decay device 22, then the alarm comparator/timer 24 is tripped, signalling an alarm state to the alarm output devices identified as alarm relay output 26, alarm LED output 28 (given that the LED is enabled by the LED on/off jumper 30).

After a fixed duration output devices 26 and 28 are re-set as is the energy accumulation storage device 20 by the alarm comparator/timer 24.

The components and functions contained within outline 49 can be carried out by a microprocessor using digital techniques or by analogue techniques. As the levels of analysis, increase the benefits of using a microprocessor are more easily justified.

The constant energy decay device 22 must decay at a rate suitable to facilitate "memorization" of recent events for some minimum time duration.

The prior art systems trigger their detection mechanism at some predefined threshold. This is done in order to minimize the probability of false alarms and results in essentially 30% of the information contained in the area under the signal being ignored. This is done as the algorithms that are used are unable to properly discriminate the information as only one time constant is used. The present technique, particularly in the microprocessor based environment, can utilize this information for background thermal "noise monitoring" which may be used to evaluate the working environment of the detector.

The different weighting factors may be dynamically altered to enable the detector to adapt itself to temperature or environmental changes and thus maintain high sensitivity.

The information sensed and produced by the algorithm may be interpreted and processed using FUZZY LOGIC processing techniques. Fuzzy logic is a form of artificial intelligence which enables decisions to be made based on imprecise, non-numerical information, much the same way as humans do. This technique could facilitate "intelligent", dynamic alteration of the weighting factors by embedding the intelligence of the product designer into each detector. Any source of information produced by the system which may be described by a "linguistic variable" may be processed using fuzzy logic techniques. For example:

1. The "weighting_factor" may be defined as VERY LOW/LOW/MED/HIGH/VERY HIGH
2. The "ambient temperature" may be defined as COLD/COOL/COMFORTABLE/WARM/HOT
3. The "weight_change" may be defined as NEGATIVE-LARGE/NEGATIVE-SMALL/NONE/-POSITIVE-SMALL/POSITIVE-LARGE By using a set of "IF-THEN" rules (A Fuzzy Inference System), a particular weighting factor (:weight_n") may be adjusted according to the following rule:

if AMBIENT TEMPERATURE is COLD and the WEGHTING_FACTOR for "weight_n" is LOW THEN WEIGHT_CHANGE for "weight_n" is NEGATIVE SMALL Although the above example is based on three data sources, it will be appreciated that any variable sensed or produced by a motion detection system (single or dual technology) which may be assigned a "Linguistic variable" may be processed using Fuzzy Logic techniques.

The major advantage of using fuzzy logic techniques is to further reduce susceptibility to false alarms caused by the fixed thresholds in the motion detection system by offering an accurate means of adapting the detector's coefficients to suit its environment.

Figure 2:
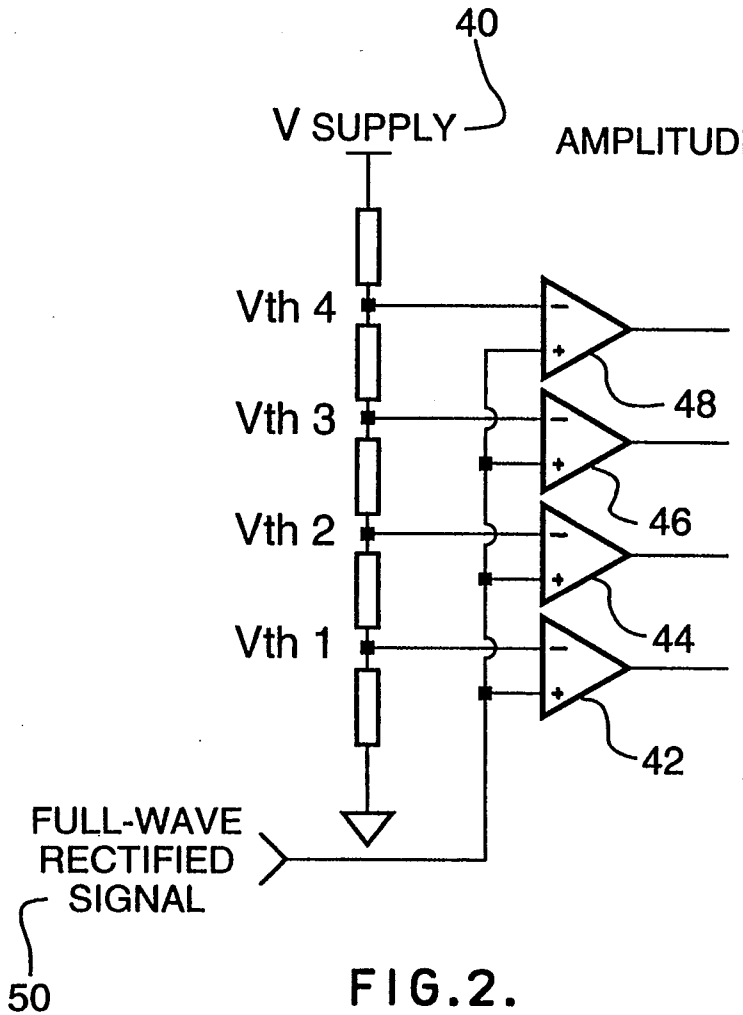
FIG. 2 is a schematic of an alternate arrangement showing a system of four comparators.

FIG. 2 shows a voltage supply 40 supplying each of the four comparators 42, 44, 46 and 48. These comparators receive the full wave rectified signal indicated as 50. The four level comparators have different minimum thresholds ($V_1$–$V_4$) with comparator 42 producing the first pulse indicated in FIG. 3 as 52 and comparator 44 producing pulse 54 and comparator 46 producing pulse 56 and comparator 48 producing pulse 58.

In this case the output from a full wave rectified symmetrical pulse so indicated at the top of FIG. 3 is being analysed. Four pulses are produced indicated as pulses 52, 54, 56 and 58. The first pulse 52 is of the longest duration and each of the pulses 58, 56 and 54 occur within the duration of pulse 52. Similarly, pulses 56 and 58 occur within the duration of pulse 54 and pulse 58 occurs within the duration of pulse 56.

It can also be appreciated from a review of the pulses of FIG. 3 that an approximation of the symmetrical signal so shown at the top of the figure has been reproduced. By adding more comparators, additional accuracy can be achieved. Furthermore, the applying of the weighting factors to the different stages can allow further discrimination of the events causing these disturbances.

Figure 4:
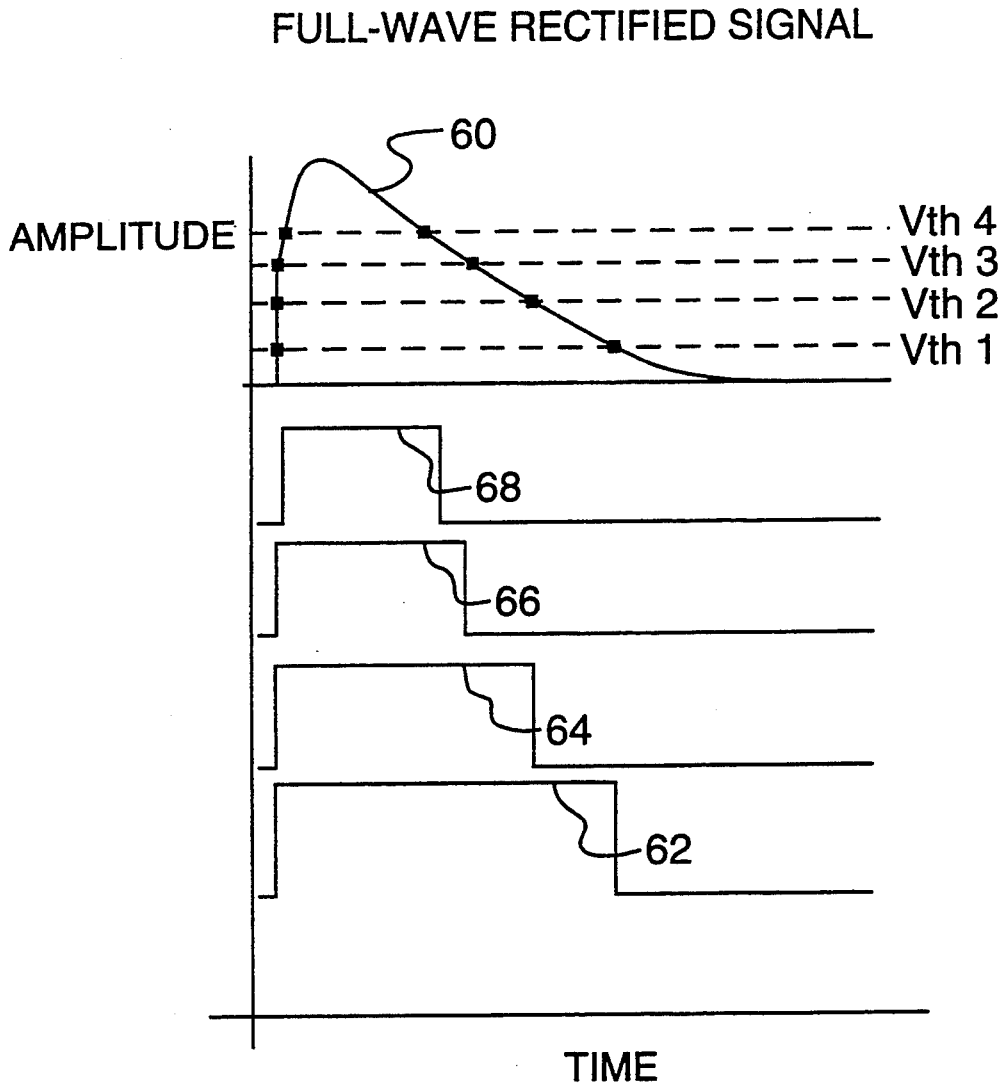
FIG. 4 is a time vs. amplitude chart showing the pulses produced from the arrangement of FIG. 2 analysing the full wave rectified signal produced from a transient RF disturbance.

FIG. 4 show the pulses produced when a full wave rectified transient RF signal indicated as 60 is being processed by the comparators. As can be seen there is an almost instantaneous tripping of the various comparators 42, 44, 46 and 48 followed by a staged reset corresponding to the decay function of the full wave rectified signal. With this information the pulse symmetry detector 14 can distinguish this as an RF signal which is to be reduced in importance or filtered out. As previously described with respect to FIG. 1, different weighting factors can be applied to the pulses once it has been recognized as an RF signal or the signal can be ignored. The microprocessor based system allows the weighting factors to be changed as an RF transient signal is recognized to reduce or eliminate the importance thereof.

With this system, non linear complifying of the signal from the detector occurs to allow adjustments for frequency characteristics of the signal detector while the weighting factors accommodate adjustments based on signal amplitude.

The system has been described with respect to an analogue arrangement, however, it can easily be carried out digitally using a microprocessor. This arrangement is more suitable for higher levels of evaluation for example 4 or more levels of analysis or where the ability to alter weighting factors during processing is desired.

Although the invention has been described herein in detail it will be understood by those skilled in the art that variations may be made thereto without departing from the spirit of the invention or the scope of the appended claims.

The embodiments of the invention in which an exclusive property or privilege is claimed are defined as follows:

1. A method for processing an output signal from a passive infrared detector of an intrusion detection system, which output signal corresponds to the changes in infrared energy in the area being monitored, said method comprising the steps of processing the output signal to produce at least first and second sets of pulses, each pulse of said first set of pulses being produced when the output signal amplitude exceeds a first predetermined level and being of a duration corresponding to the duration the output signal is maintained above the first predetermined level, each pulse of the second set of pulses being produced only when a pulse of said first set of pulses is present and the output signal exceeds a second predetermined level which is higher than the first predetermined level, said second set of pulses each being of a duration corresponding to the duration the output signal is maintained above the second predetermined level, and analysing said sets of pulses for a combined minimum energy level indicative of an alarm condition and producing an alarm when the analysis indicates the combined minimum energy level is exceeded.

2. A method as claimed in claim 1 wherein said step of analysing said sets of pulses includes combining said first set of pulses with said second set of pulses to produce a combined signal which is analysed for the presence of an alarm condition.

3. A method as claimed in claim 2 further comprising the step of applying respective weighting factors to the sets of pulses prior to combining said sets of pulses whereby at least one of said sets of pulses has an increased effect on the combined signal.

4. A method as claimed in claim 3 further comprising the step of comparing said sets of pulses and reducing said combined signal for a short time period when pulses of each set occurs essentially at the same time indicating the possible occurrence of RF induced transients.

5. An arrangement for processing an output signal from a passive infrared detector of an intrusion detection system, which output signal corresponds to the changes in the area being monitored, comprising a series of comparators having different stepped minimum thresholds which are within a range of normal values of the output signal and through which the output signal is processed to compare the output signal amplitude to the stepped minimum thresholds, means for producing an output signal of predetermined amplitude from each comparator and of a duration corresponding to the duration the detector output signal is above the respective minimum threshold, means for applying a different weighting factor to the output signal from each comparator to produce weighted signals, means for evaluating the weighted signals by combining and accumulating for a period of time the weighted signals to produce a measured value and means for producing an alarm when the measured value exceeds a predetermined level indicative of an intruder in the area being monitored.

6. An arrangement as claimed in claim 5 wherein the weighting factors progressively increase in accordance with the magnitude of the respective minimum thresholds.

7. An arrangement as claimed in claim 6 wherein the detector output signal to be processed has a frequency between 0.1 to 10 Hz.

8. An arrangement as claimed in claim 7 wherein the detector output signal voltage is in the range of 0 to 5 volts.

9. An arrangement as claimed in claim 5 wherein said series of comparators is two comparators.

10. An arrangement as claimed in claim 5 further including signal analysing means which analyses the comparator output signals for instantaneous type change indicative of a detection of an RF transient signal and compensates therefor prior to evaluating the combined weighted signals.

11. An arrangement as claimed in claim 5 wherein said series of comparators is at least four comparators.

12. A method of processing an output signal from a passive infrared detector of an intrusion detection system comprising the steps of receiving the output signal from the infrared detector, filtering the output signal to produce a modified signal representative of infrared radiation changes in an area being monitored by said infrared detector, amplifying and rectifying the modified signal to produce a resulting signal, and dividing the resulting signal into at least two portions according to different voltage level ranges of the resulting signal and applying a different weighting factor for each portion of the resulting signal and analysing the weighted portions of the resulting signal for a combined minimum energy level indicative of an intruder in the area being monitored, and producing an alarm signal when the minimum energy level is exceeded.

13. A method as claimed in claim 12 further comprising evaluating said portions of the resulting signal for the presence of transient signals known not to indicate a human intruder and modifying the resulting signal to correct for said transient signals prior to analysing said weighted portions of the resulting signal.

14. A method as claimed in claim 12 further including the step of filtering out any portion of said resulting signal in which said at least two portions of the resulting signal are simultaneously present.

15. A method as claimed in claim 12 wherein at least some of said steps are performed by an analogue circuit.

16. A method as claimed in claim 12 further comprising the steps of assessing different environmental conditions and altering the weighting factors as a function of the assessed environmental conditions.

17. An intrusion detection system comprising a passive infrared detector in combination with a processor, said passive infrared detector monitoring an area for changes in infrared energy and producing an output signal based on the infrared energy in the area being monitored, said processor including an arrangement which based on said output signal produces at least first and second sets of pulses, each pulse of said first set of pulses being produced by said arrangement when the output signal amplitude exceeds a first predetermined level and being of a duration corresponding to the duration the output signal is maintained above the first predetermined level, each pulse of the second set of pulses being produced by said arrangement only when a pulse of said first set of pulses is present and the output signal exceeds a second predetermined level of said arrangement which is higher than the first predetermined level, said second set of pulses each being of a duration corresponding to the duration the output signal is maintained above the second predetermined level; said processor further including an analysing arrangement which analyses said sets of pulses to determine whether a minimum energy level indicative of an intruder in the monitored area has been exceeded and produces an alarm signal when the minimum energy level is exceeded.

18. An intrusion detection system as claimed in claim 17 wherein said processor includes a weighting structure which applies a different weighting factor to each set of pulses prior to said analysing arrangement.

* * * * *